US005864895A

United States Patent [19]

Ota et al.

[11] Patent Number: 5,864,895

[45] Date of Patent: Feb. 2, 1999

[54] HANDY BODY WASHER

[75] Inventors: Masuo Ota; Miho Shirakawa; Shigehiko Fujita, all of Kadoma; Katsumi Nishimura, Kitakyushu; Yoshitaka Ezoe, Kitakyushi; Kinya Kawanobe, Kadoma; Hajime Miyazaki, Kitakyushi, all of Japan

[73] Assignees: Toto Ltd; Matsushita Electric Industrial Co, Ltd, both of Japan

[21] Appl. No.: 863,569

[22] Filed: May 27, 1997

Related U.S. Application Data

[60] Provisional application No. 60/018,387 May 29, 1996.

[30] Foreign Application Priority Data

Mar. 10, 1997 [JP] Japan ..... 9-054514
Mar. 10, 1997 [JP] Japan ..... 9-054515

[51] Int. Cl.[6] ..... A61H 35/00

[52] U.S. Cl. ..... 4/443; 4/448; 601/154; 601/160

[58] Field of Search ..... 4/443, 448, 420.4, 4/447; 601/154, 159, 160, 167, 169

[56] References Cited

U.S. PATENT DOCUMENTS

| | | | |
|---|---|---|---|
| 3,731,676 | 5/1973 | Rebold | 601/160 |
| 3,808,608 | 5/1974 | Caplan | 4/448 |
| 4,622,704 | 11/1986 | Chung | 4/443 |
| 4,628,548 | 12/1986 | Kurosawa et al. | 4/443 X |
| 4,704,748 | 11/1987 | Takeda et al. | 4/448 X |
| 5,097,540 | 3/1992 | Lovitt | 4/443 |

FOREIGN PATENT DOCUMENTS

| | | | |
|---|---|---|---|
| 90/07900 | 7/1990 | Japan | 4/443 |
| 406010393 | 1/1994 | Japan | 4/448 |
| 406088370 | 3/1994 | Japan | 4/443 |

*Primary Examiner*—David J. Walczak
*Assistant Examiner*—Kathleen J. Prunner
*Attorney, Agent, or Firm*—Beyer & Weaver, LLP

[57] ABSTRACT

A handy body washer comprises: a main body; a pump accommodated in the main body, a tank, slidably attached to the main body to house the main body therein, and a retractable nozzle member connected to the main body. The nozzle member has a free end and a plurality of nozzle apertures formed proximate the free end. The tank comprises: (i) a bottomed cylindrical body having an open top end and a bottom end, where the bottom end has a water supply opening; (ii) a water supply cover pivotally supported on the bottom end for opening and closing the water supply opening; and (iii) a gutter formed in an inner surface of the water supply cover for introducing the washing water flowing downward into the water supply opening while the water supply cover is open.

13 Claims, 15 Drawing Sheets

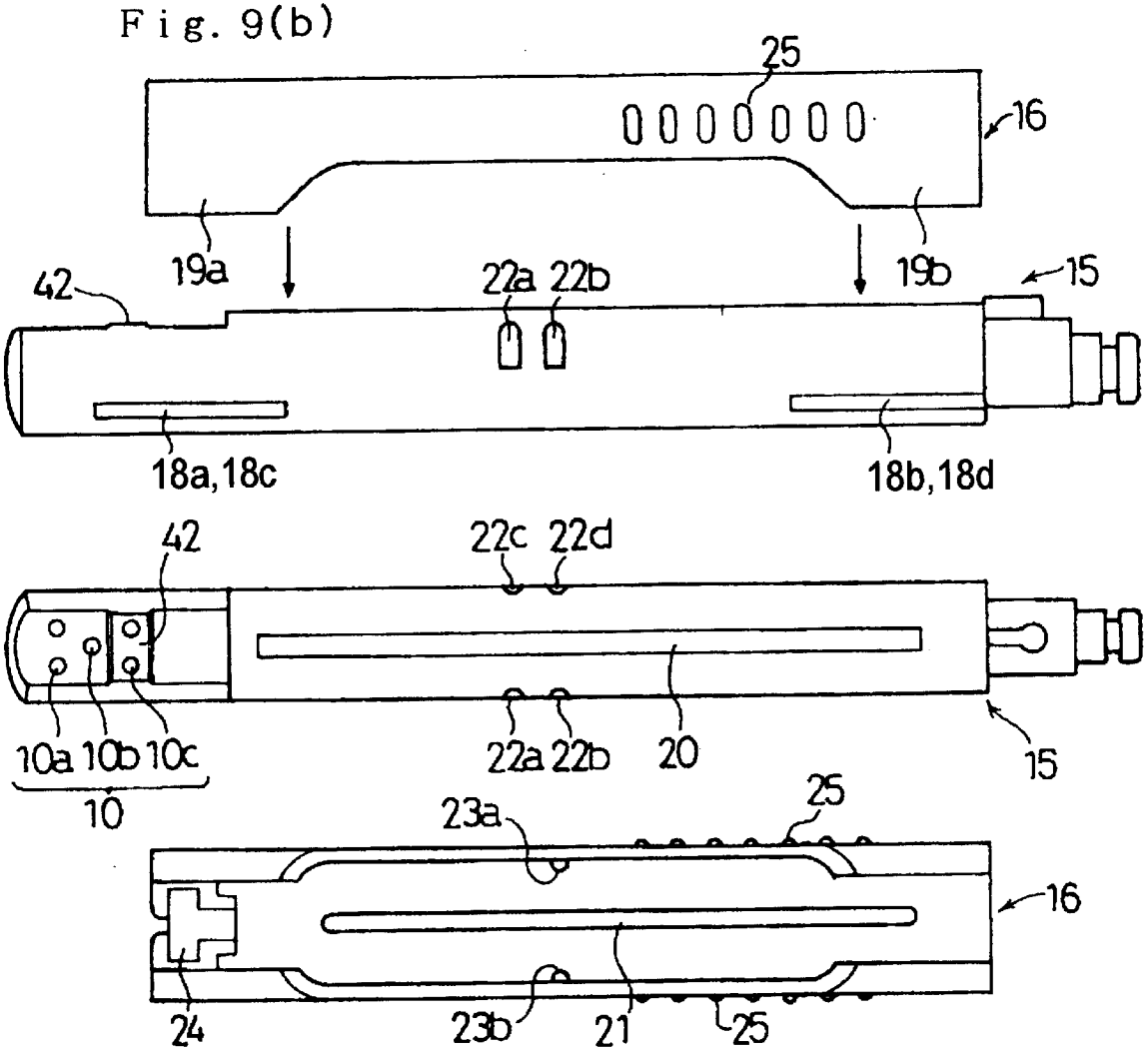
Fig. 9(b)
Fig. 9(c)
Fig. 9(d)
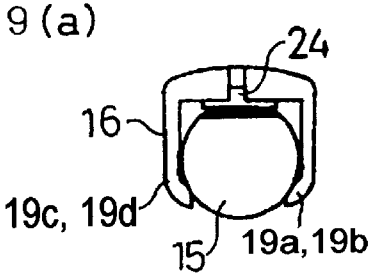
Fig. 9(a)

51 MAIN BODY UNIT
52 TANK UNIT
53 NOZZLE
54a CELL
55 SWITCH
56 MOTOR
57 PUMP
58 SUCTION INLET
59 NOZZLE-RECEIVING MEMBER
60 JET NOZZLES
63 END FACE
65a, 65b NARROW-WIDTH FACES

HANDY BODY WASHER

CROSS REFERENCE TO RELATED APPLICATION

The present invention claims priority of U.S. provisional patent application Ser. No. 60/018,387, entitled "Handy Body Washer", filed May 29, 1996, which is incorporated herein by reference in its entirety.

BACKGROUND OF THE INVENTION

1. Field of the Invention

The present invention relates to a handy body washer that is used especially for bathing the posterior parts and the external genitals of the body.

2. Description of the Related Art

With increased concern about the health and cleanness, body washers and bidets are used commonly. The body washer or bidet is generally fixed to the seat of the toilet. While washing water is jetted out of a nozzle projected from a main body of the body washer, the nozzle swings back and forward or left and right to bathe the posterior parts and the external genitals of the body. In the body washer of such structure, tap water is directly fed into the main body and used as washing water. Recently the needs for a body washer which can be used even out of the house are greatly increasing.

SUMMARY OF THE INVENTION

Accordingly, an object of the present invention is to provide a portable handy body washer.

Another object of the present invention is to improve portability of a handy body washer.

Still another object of the present invention is to facilitate water supply to a tank of a handy body washer.

In order to attain at least part of the above and other objects of the present invention, there is provided a handy body washer comprising: a main body; a pump accommodated in the main body; a tank, slidably attached to the main body to house the main body therein, for storing washing water; and a retractable nozzle member, connected to the main body, having a free end and a plurality of nozzle apertures formed proximate the free end, the plurality of nozzle apertures jetting out the washing water pumped out by the pump. The tank comprises: (i) a bottomed cylindrical body having an open top end and a bottom end, the bottom end having a water supply opening; (ii) a water supply cover pivotally supported on the bottom end for opening and closing the water supply opening; and (iii) a gutter formed in an inner surface of the water supply cover for introducing the washing water flowing downward into the water supply opening while the water supply cover is open.

Since the water supply opening is arranged on the bottom of the tank, a large part of the main body can be received in the tank during carriage, thereby reducing the whole volume of the handy body washer during carriage and improving the portability.

While the water supply cover is open to supply water to the tank, the gutter arranged on the inner surface of the water supply cover turns the flow of water toward the opening. Even when there is only a small space between the faucet and the basin in a washing room and the user should hold the handy body washer in an inclined attitude, the gutter introduces water flowing downward into the tank, thereby enabling washing water to be readily stored in the tank.

In a preferred embodiment, the gutter is arranged to face toward the water supply opening when the water supply cover is held at a predetermined opening angle. The gutter may comprise a restriction plate arranged inside the gutter for working as a splash guard.

According to another aspect of the present invention, a handy body washer comprises: a main body; a pump accommodated in the main body; a tank for storing washing water; a nozzle member, connected to the main body, having a free end and a plurality of nozzle apertures formed proximate the free end, the plurality of nozzle apertures jetting out the washing water pumped out by the pump; and nozzle adjusting means for adjusting a number of the nozzle apertures to be used to jet out the washing water.

In a preferred embodiment, the nozzle adjusting means comprises a sealing member, sidably attached to the nozzle member, for closing and opening a first part of the plurality of nozzle apertures while maintaining a second part of the plurality of nozzle apertures open. The first part of the plurality of nozzle apertures may be formed at an elevation higher than the second part of the plurality of nozzle apertures, and wherein the nozzle adjusting means comprises means for moving the sealing member slidably onto the elevation to close the first part of the plurality of nozzle apertures.

The present invention is also directed to a handy body washer used for bathing the posterior parts or the external genitals of the body, which includes: a main body with a washing mechanism integrally accommodated in a casing, a liquid being jetted from the washing mechanism in order to bathe the posterior parts or the external genitals of the body; a tank which can store the liquid in use and receive the main body in carriage; a water supply inlet through which the liquid is supplied into the tank; and a tank unit having a suction valve and an exhaust valve, wherein the tank unit has a sliding surface which slides against the main body and has inner diameter gradually decreasing towards an end of the tank, the main body being slidingly inserted into the tank unit via a substantially Y-shaped packing.

In a preferred embodiment, the washing mechanism further includes a cell functioning as a power source, a motor driven by electric power supplied from the cell, a pump activated by the motor, and a nozzle through which a liquid fed by the pump is discharged.

The substantially Y-shaped packing is preferably composed of ethylene propylene rubber or fluororubber coated with a fluorine admixture or silicone rubber.

The pump used herein is one selected among the group consisting of a gear pump, a vane pump, a Roots blow pump, a diaphragm pump, and a piston pump.

In another embodiment, the suction valve and the exhaust valve are arranged in a substantially concentric configuration, in which the suction valve constitutes an inner concentric circle and the exhaust valve an outer concentric circle.

It is also preferable that the water supply inlet has an elliptical shape whose minor axis is arranged in a longitudinal direction of the tank.

In the handy body washer of the present invention thus constructed, the substantially Y-shaped packing attached to the main body effectively prevents the remaining water from leaking from the tank even with a draft taper and enables the main body to securely slide against the tank. This effect is especially enhanced when the substantially Y-shaped packing is composed of ethylene propylene rubber or fluororubber coated with a fluorine admixture or silicone rubber. Any one of the gear pump, the vane pump, the Roots blow pump, the diaphragm pump, and the piston pump can give an appropriate jetting rate of washing water to realize the sufficient bathing effect.

The air valve working in dual-directions enables the air to be sucked into the tank when washing water is jetted out and to be discharged from the tank when the main body is received in the tank. The elliptical water supply inlet makes the tank unit sufficiently compact without sacrificing the convenience of water supply.

The present invention is further directed to a handy body washer used for bathing the posterior parts or the external genitals of the body, which includes: a main body which a cell functioning as a power source, a motor driven by electric power supplied from the cell, and a pump activated by the motor are accommodated in; a tank unit which can store a washing liquid in use and be slidingly movable to cover the main body in carriage; and a nozzle having a first end pivotally attached to the main body and a second end with one or a plurality of jet nozzles from which the washing liquid is jetted, wherein the main body has an elliptical cylindrical member having a substantially elliptical cross section, the elliptical cylindrical member further having a switch for switching an operating condition of the motor, a nozzle-receiving member for receiving the nozzle and enabling the main body to be slidingly movable into the tank unit, and a water supply inlet for feeding the washing liquid stored in the tank unit to the pump, the switch being mounted on a first narrow-width face which is parallel to a central axis of the elliptical cylindrical member and included in a circumferential surface located on one end of a major axis of the substantially elliptical cross section, the nozzle-receiving member being disposed on a second narrow-width face which is parallel to the central axis of the elliptical cylindrical member and included in a circumferential surface located on the other end of the major axis of the substantially elliptical cross section, the water supply inlet being located on one end of the elliptical cylindrical member, which faces to the tank unit, and arranged in the vicinity of either said first narrow-width face or the second narrow-width face.

In accordance with one preferable application of the present invention, the cross section of the elliptical cylindrical member of the main body has an oval shape, the switch being mounted on a relatively smaller narrow-width face which is parallel to a central axis of the elliptical cylindrical member and included in a circumferential surface located on one end of a major axis of the oval cross section, the nozzle-receiving member being disposed on a relatively greater narrow-width face which is parallel to the central axis of the elliptical cylindrical member and included in a circumferential surface located on the other end of the major axis of the oval cross section.

These and other objects, features, aspects, and advantages of the present invention will become more apparent from the following detailed description of the preferred embodiments with the accompanying drawings.

BRIEF DESCRIPTION OF THE DRAWINGS

FIG. 9(*a*) is an end side view showing structure of the nozzle;

FIG. 9(*b*) is a decomposed view of the cylindrical section and the sliding section;

FIG. 9(*c*) is a plan view of the cylindrical section;

FIG. 9(*d*) is a bottom view of the sliding section;

FIG. 14(*b*) is a cross sectional view illustrating the handy body washer of the second embodiment in a state immediately before a conclusion of bathing.

FIG. 15(*b*) is a cross sectional view illustrating the handy body washer of the third embodiment;

FIG. 16(*b*) is a cross sectional view illustrating the Y-shaped packing used in the structure of the third embodiment.

DESCRIPTION OF THE PREFERRED EMBODIMENT

A. First Embodiment

Figure 1:
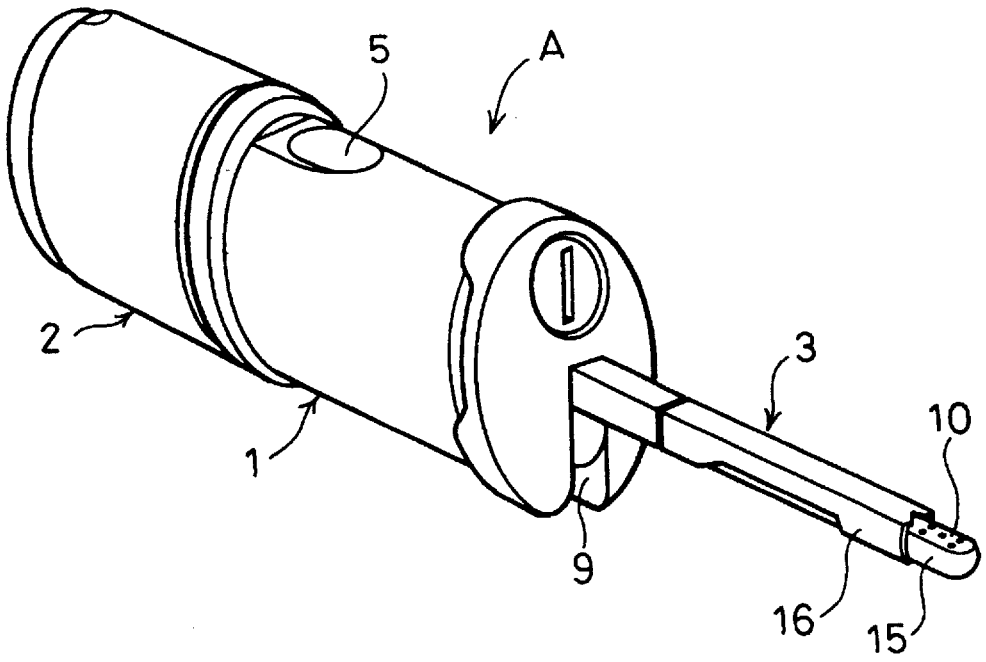
FIG. 1 is a perspective view illustrating a handy body washer embodying the present invention.

FIG. 1 is a perspective view of a handy body washer A embodying the present invention. The handy body washer A includes a main body 1 with a cell, a motor, and a pump accommodated therein, a tank 2 for storing washing water, and a nozzle 3 attached to the main body 1 to allow a pivotal movement thereof. FIG. 1 shows the handy body washer ready for use. A press of a switch 5 causes the washing water stored in the tank 2 slid out of the main body 1 to be jetted out of jet nozzles (or nozzle apertures) 10 of the nozzle 3. In carriage, the handy body washer is made compact; the nozzle 3 is pivotally moved to be set in a nozzle-receiving section 9 formed on a side portion of the main body 1, while the main body 1 is received in a space of the tank 2 for storing the washing water.

Both the main body 1 and the tank 2 have elliptical cross sections, in order to allow the user to appropriately check the direction of the nozzle 3 by only a touch of the hand. The main body 1 is formed in an elliptical cylindrical shape having a pair of narrower outer faces that are arranged on either ends of the major axis of the elliptical cross section and parallel to the center axis of the cylinder. The switch 5 is placed on one narrower face, and the groove-like nozzle-receiving section 9 for receiving the nozzle 3 is formed in the other narrower face. The tank 2 is formed in a similar elliptical cylindrical shape to fit the contour of the main body 1. The detailed structures of the main body 1 and the tank 2 are discussed below with the drawings of FIGS. 2 and 3.

Figure 2A:
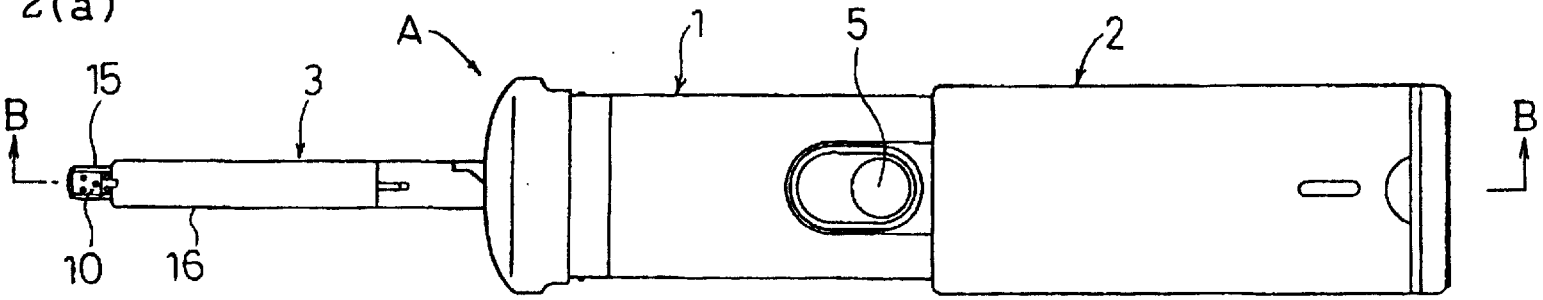
FIG. 2(*a*) is a plan view showing structure of the handy body washer, and FIG. 2(*b*) is a cross sectional view, taken on the line B—B of FIG. 2(*a*)
Figure 2B:
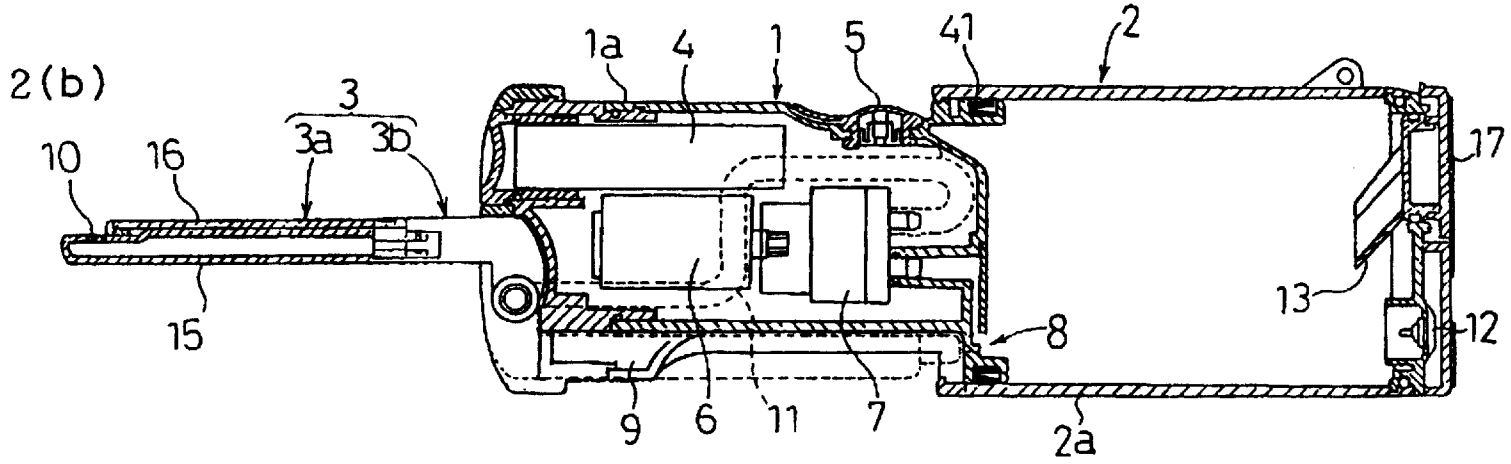
Figure 3:
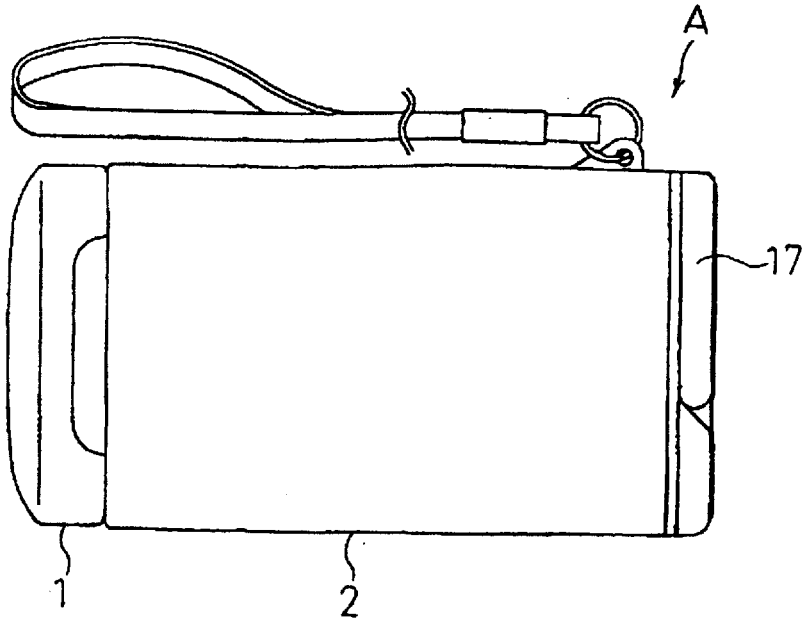
FIG. 3 is a side view showing the handy body washer in carriage.

FIG. 2(*a*) is a plan view showing the handy body washer ready for use, seen from the side of the narrower face with the switch 5. FIG. 2(*b*) is a cross sectional view, taken on the line B—B of FIG. 2(*a*). FIG. 3 is a side view showing the handy body washer in carriage.

Referring to FIG. 2, the main body 1 has the waterproof switch 5 attached thereto, and includes a cell 4, a motor 6 using the cell 4 as a power source, and a pump 7 driven by the motor 6. A casing 1*a* of the main body 1 has, on one end thereof, a packing 41 that is pressed against the inner wall of a casing 2*a* of the tank 2, and is watertightly inserted in the inner diametral portion of the tank 2 to come into contact with the reservoir space of washing water in the tank 2. The user pivotally moves the nozzle 3 to be set in the main body 1 and inserts the main body 1 into the tank 2 from the state shown in FIG. 2, in order to reduce the whole volume and make the handy body washer A sufficiently compact for carriage as shown in FIG. 3.

Figure 4:
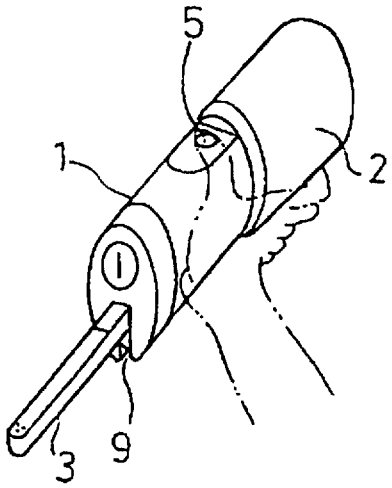
FIG. 4 is a perspective view showing an attitude of the handy body washer held with a hand for use.
Figure 5:
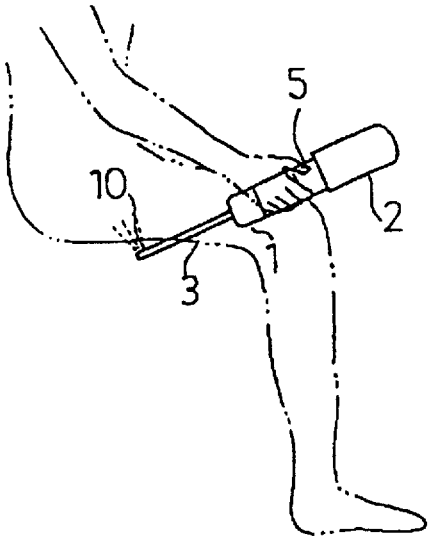
FIG. 5 schematically shows the use state of the handy body washer.

The user carries the handy body washer A in the state of FIG. 3. In use, the user slides the main body 1 out of the tank 2, opens a water supply cover 17 of the tank 2, pours water into the tank 2, closes the water supply cover 17, and pulls the nozzle 3 out of the main body 1. A press of the switch 5 actuates the motor 6, pumps out the washing water stored in the tank 2 by means of the pump 7, and causes the washing water to be fed to the nozzle 3 through a feed pipe 11 and jetted out of the jet nozzles 10. The user holds the main body 1 and the tank 2 with a hand and presses the switch 5 with the thumb as shown in FIG. 4. When the user presses the switch 5 while facing the jet nozzles 10 of the nozzle 3 toward the posterior parts or the external genitals of the body as shown in FIG. 5, the washing water showers the posterior parts or the external genitals of the body. The user can arbitrarily change the position showered by the washing water.

In the course of washing, the washing water in the tank 2 gradually decreases. An air valve 12 is disposed on the bottom of the tank 2, in order to allow the air flow between the sealed space in the tank 2 and the exterior. When the main body 1 is slid into the tank 2 for carriage, the air valve 12 releases the air remaining in the tank 2 to the outside, so as to allow a smooth slide of the main body 1 into the tank 2.

Figure 6:
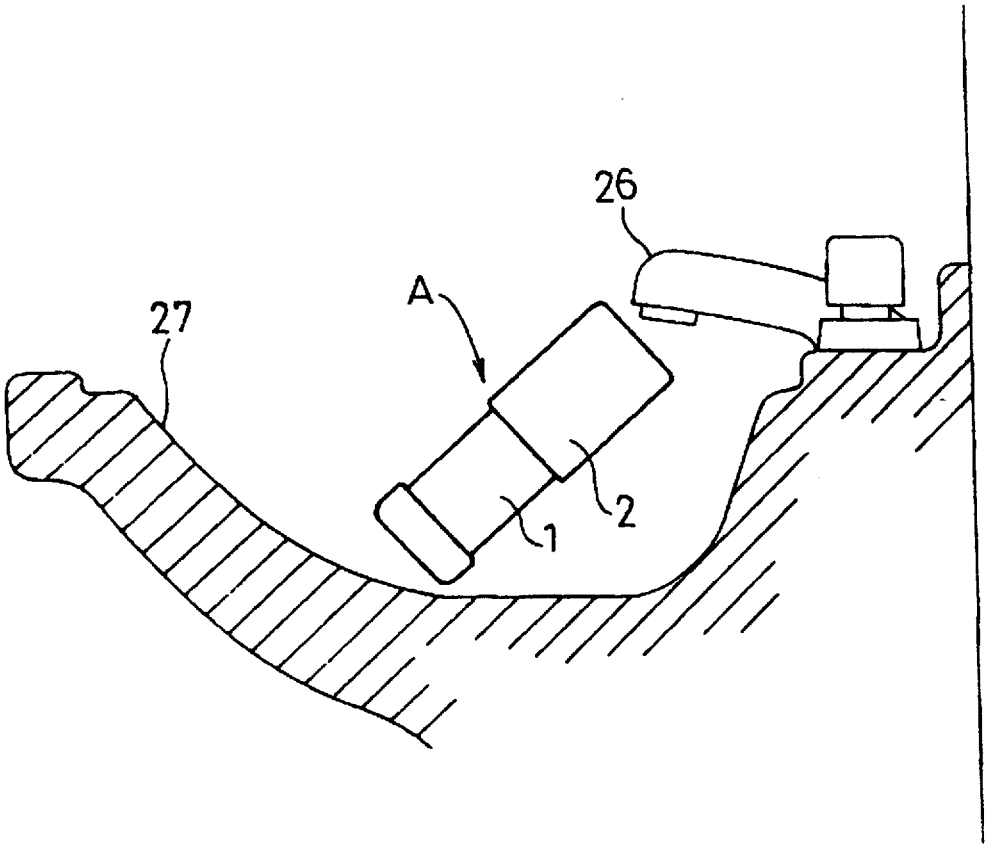
FIG. 6 shows the state of water supply into the tank.

The washing water stored in the tank 2 is generally obtained from the tap. Outside the house, the user is restricted to obtain water from the faucet of the basin in washrooms and lavatories. Since there is a washbowl, such as a basin 27, under a faucet 26 as shown in FIG. 6 , it is generally impossible to hold the handy body washer A upright under the faucet 26 to feed the tap water into the tank 2. The user should accordingly hold the handy body washer A in an inclined orientation to locate the water supply inlet under the faucet 2 and feed water into the tank 2. A specific water supply structure is formed on the bottom of the tank 2, in order to enable water to be readily fed into the tank 2 under such conditions.

Figure 7:
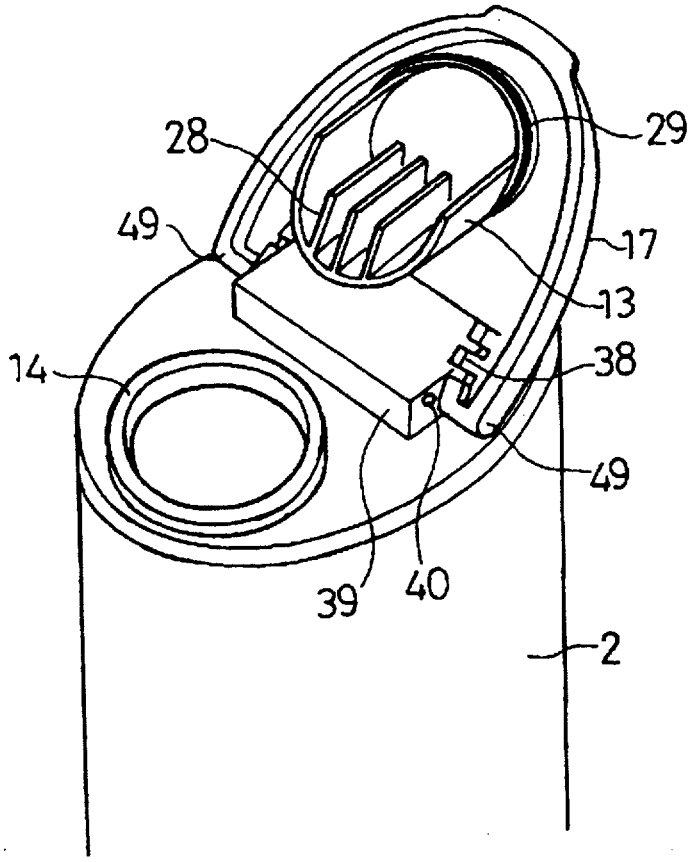
FIG. 7 is a perspective view illustrating structure of the water supply cover.
Figure 8:
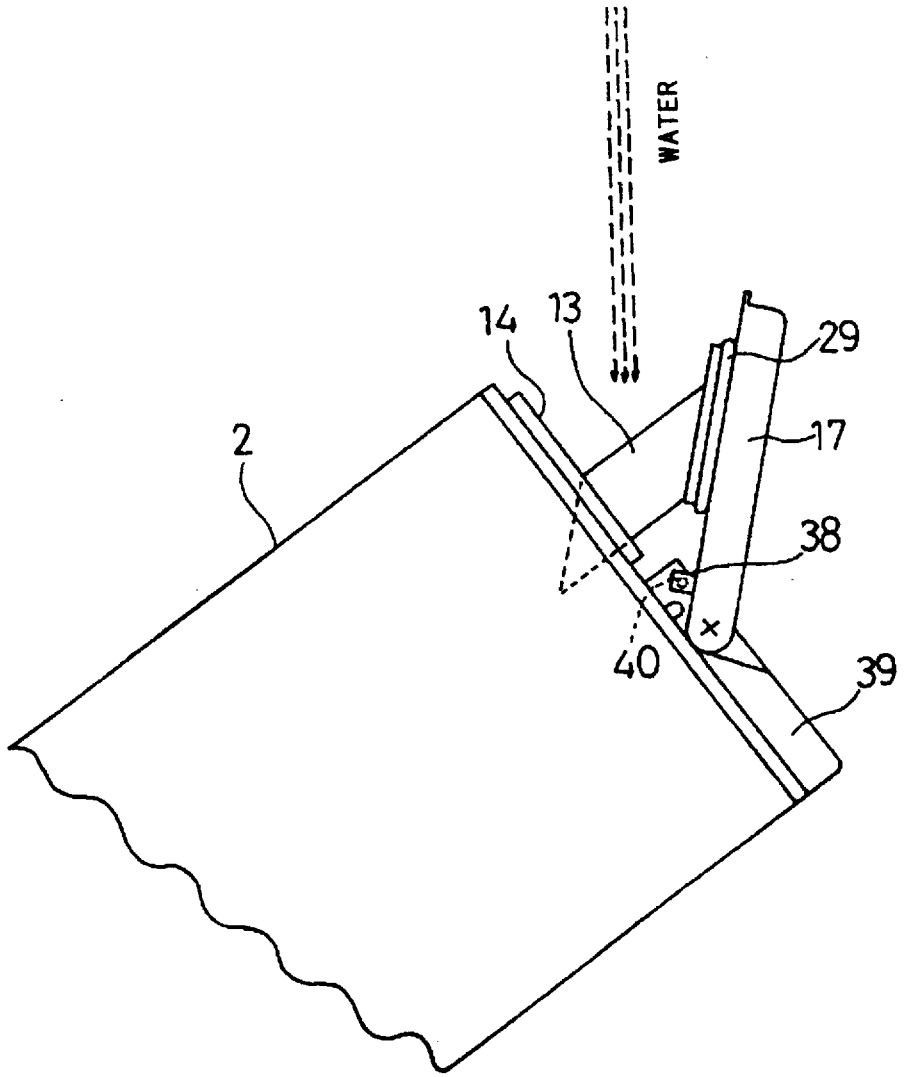
FIG. 8 is a side view showing a specific state, in which the water supply cover is held at a predetermined opening angle.

FIG. 7 is a perspective view illustrating the water supply structure. The water supply cover 17 for opening and dosing a water supply opening 14 is pivotally attached to a base 39 formed on the bottom of the tank 2. The water supply cover 17 pivotally moves around a pair of pivotal arms 49,49, which are pivotally supported to the base 39, from the full-close position to the full-open position shown in FIG. 7. The water supply cover 17 can be held at a predetermined opening angle. In case that the handy body washer A can be held upright below the faucet, the water supply cover 17 is set in the full-open position while water is poured into the tank 2 through the water supply opening 14. In case that there is no sufficient space below the faucet 26 and the handy body washer A should be held in an inclined orientation as shown in FIG. 6, on the other hand, the water supply cover 17 is held at the predetermined opening angle shown in FIG. 8 . In this state, a gutter 13 formed in the inner face of the water supply cover 17 faces toward the tank 2, receives the tap water flown downward as shown by the arrows, and changes the direction of the flow into the tank 2. A row of restriction plates 28 functioning as a splash guard are arranged inside the gutter 13 as shown in FIG. 7. The row of restriction plates 28 arranged toward the tank 2 prevents the whole handy body washer A from being wet by the splash of water and ensures a smooth flow of water into the tank 2. Even in the inclined orientation of the handy body washer A, the gutter 13 enables the user to readily fill the tank 2 up with water.

A projection of an engagement piece 38 formed on the stem portion of the water supply cover 17 is fitted into an engagement aperture 40 formed in the base 39 that supports the water supply cover 17, thereby holding the water supply cover 17 at the predetermined opening angle. When a plurality of engagement apertures 40 are formed in the pivotal direction, the water supply cover 17 can be held at a plurality of opening angles. An O ring 29 is set around the stem portion of the gutter 13 of the water supply cover 17. In the full-dose position of the water supply cover 17, the O ring 29 is pressed against the inner wall of the opening 14, so as to prevent leakage of the washing water stored in the tank 2.

The casing 2*a* of the tank 2 is composed of a translucent or transparent material, in order to enable the user to readily check the remaining amount of washing water stored therein. The washing water stored in the tank 2 is sucked through a suction inlet 8 (see FIG. 2) by means of the pump 7 and fed into the nozzle 3.

Referring back to the drawing of FIG. 2, the nozzle 3 of the handy body washer A of the embodiment has a cylindrical section 15 and a sliding section 16. The sliding section 16 moves on the cylindrical section 15 between a 'High' position that is closer to the free end of the nozzle 3 and a 'Low' position that is closer to the main body 1. A total of five jet nozzles 10 that are arranged two, one, two in three rows are formed on the end of the cylindrical section 15. When the sliding section 16 is moved toward the free end of the nozzle 3 to the 'High' position, the two jet nozzles 10 on the side of the main body 1 are blocked and washing water is jetted out of the remaining three jet nozzles 10. The washing water fed under a constant pressure by the pump 7 is jetted out of the less number of jet nozzles 10 and thereby has a greater jet pressure. This is suitable to wash the anus and posterior parts of the body after stool with the strong jet flow.

When the sliding section 16 is moved toward the main body 1 to the 'Low' position, on the other hand, washing water is jetted out of all the five jet nozzles 10. The washing water fed under a constant pressure by the pump 7 is jetted out of the greater number of jet nozzles 10 and thereby has a smaller jet pressure. This is suitable to wash the external genitals of the body with the gentle jet flow.

The switching mechanism of the jet pressure in the sliding section 16 has the structure shown in FIG. 9. The sliding section 16 and the cylindrical section 15 constitute jet nozzle switching means.

As shown in FIG. 2, the nozzle 3 has a pivotal section 3*b* pivotally supported by the main body 1 and an end section 3*a* connected to the pivotal section 3*b*. As shown in the end side view of FIG. 9(*a*) and the decomposed view of FIG. 9(*b*), the end section 3*a* is constructed by fitting the sliding section 16 into the cylindrical section 15.

Figures 10A, 10B:
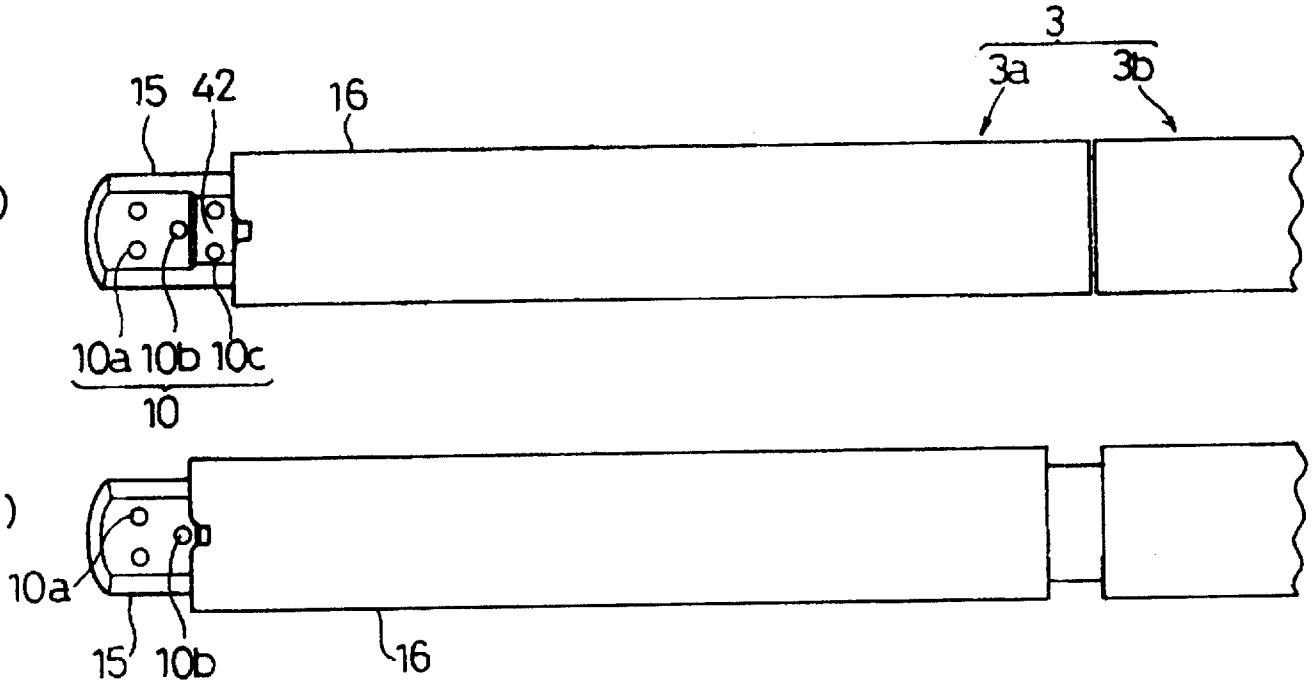
FIGS. 10(*a*) and 10(*b*)are plan views showing the low jet flow position and the high jet flow position of the nozzle.

Four engagement pieces 19*a* through 19*d* (19*d* is arranged opposite to 19*b*) of the sliding section 16 are fitted into engagement slits 18*a* through 18*d* (18*c* and 18*d* are arranged opposite to 18*a* and 18*b*) formed in the cylindrical section 15, while a projection 21 shown in FIG. 9(*d*) of the sliding section 16 is fitted into a sliding groove 20 of the cylindrical section 15 shown in FIG. 9(*c*). This structure enables the sliding section 16 to freely slide in the longitudinal direction. The sliding distance of the sliding section 16 is defined by fitting a pair of nails 23*a* and 23*b* formed on the sliding section 16 shown in FIG. 9(*d*) into apertures 22*a* through 22*d* formed in the cylindrical section 15 shown in FIG. 9(*c*). As shown in FIG. 9(*d*), a T-shaped seal member 24 composed of silicone rubber is arranged inside the end portion of the sliding section 16. When the sliding section 16 is moved toward the free end of the nozzle 3, the seal member 24 blocks two jet nozzles 10*c* arranged on the side of the main body 1. The jet nozzles 10*c* are formed in a little higher step 42 than the other jet nozzles 10*a* and 10 *b*, so that the seal member 24 comes into press contact with the openings to block the jet nozzles 10*c*. The user holds an anti-slip area 25 formed on both sides of the outer face of the sliding section 16. When the jet nozzles 10*c* are open, washing water is jetted out of all the five jet nozzles 10*a* through 10*c* as shown in FIG. 10(*a*) and is suitable to function as a bidet with the gentle jet pressure. When the jet nozzles 10*c* are blocked by the sliding section 16, on the other hand, washing water is jetted out of the remaining three jet nozzles 10*a* and 10*b* as shown in FIG. 10(*b*) and is suitable to function as a washer with the strong jet pressure.

Washing water fed to the nozzle 3 is sucked through the suction inlet 8 (see FIG. 2) by the pump 7. The suction inlet 8 is located on the lower most end of the inclined tank 2 when the handy body washer A is held for use in an inclined attitude with the jet nozzles 10 of the nozzle 3 facing upward. This configuration allows the washing water stored in the tank 2 to be fed into the nozzle 3 by the pump 7 without waste. Since the tank 2 has the elliptical cylindrical shape, the suction inlet 8 is located on the lower end of the narrower face of the elliptical cross section that has a small width in the horizontal direction.

The elliptical shape of the tank 2 and the main body 1 enables the user to substantially use up the washing water stored in the tank 2 and to readily change the direction of washing water jetted out of the nozzle 3. Although it is difficult to observe the direction of the jet flow of washing water, the user can rotate the handy body washer A only by a shift of fingers while pressing the switch 5 located on the upper portion of the elliptical cross section with the thumb and supporting the narrower face on the lower portion with the other four fingers as shown in FIGS. 4 and 5. The user can thus readily change the direction of the jet flow of washing water while the handy body washer A is located under the posterior parts or the external genitals of the body.

As discussed above, in the structure of the present invention, the water supply opening, through which water is fed into the tank, is arranged on the bottom of the tank. This increases the volume of the main body that can be received in the tank for carriage, thereby reducing the whole volume of the handy body washer in carriage and improving the portability. The gutter arranged on the inner surface of the water supply cover introduces the flow of tap water flowing downward into the tank. Even when there is only a small space between the faucet and the basin and the user should hold the handy body washer in an inclined attitude, the gutter enables the user to readily store water in the tank.

B. Second Embodiment

Figure 11:
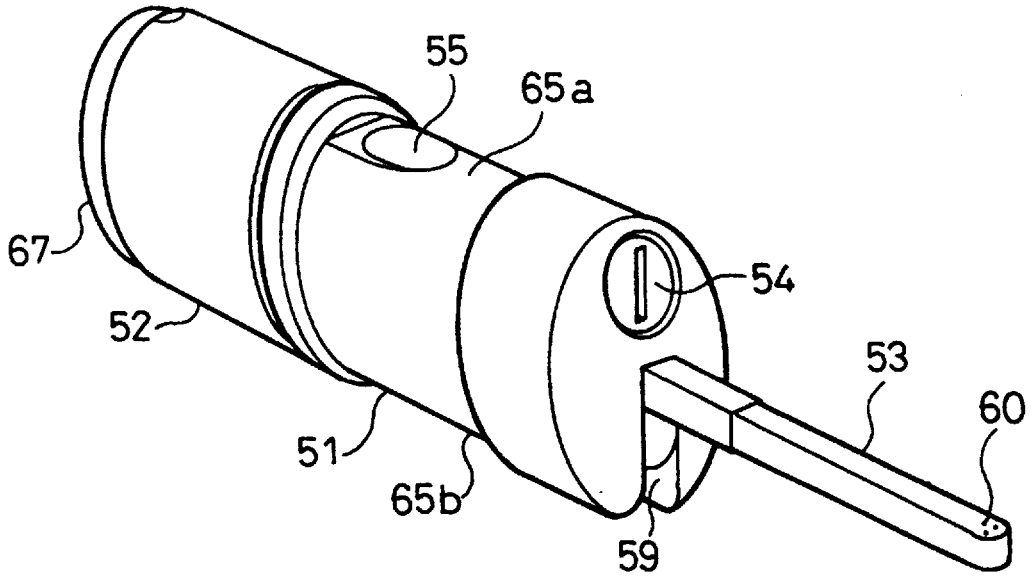
FIG. 11 is a perspective view illustrating another handy body washer as a second embodiment according to the present invention.
Figure 12:
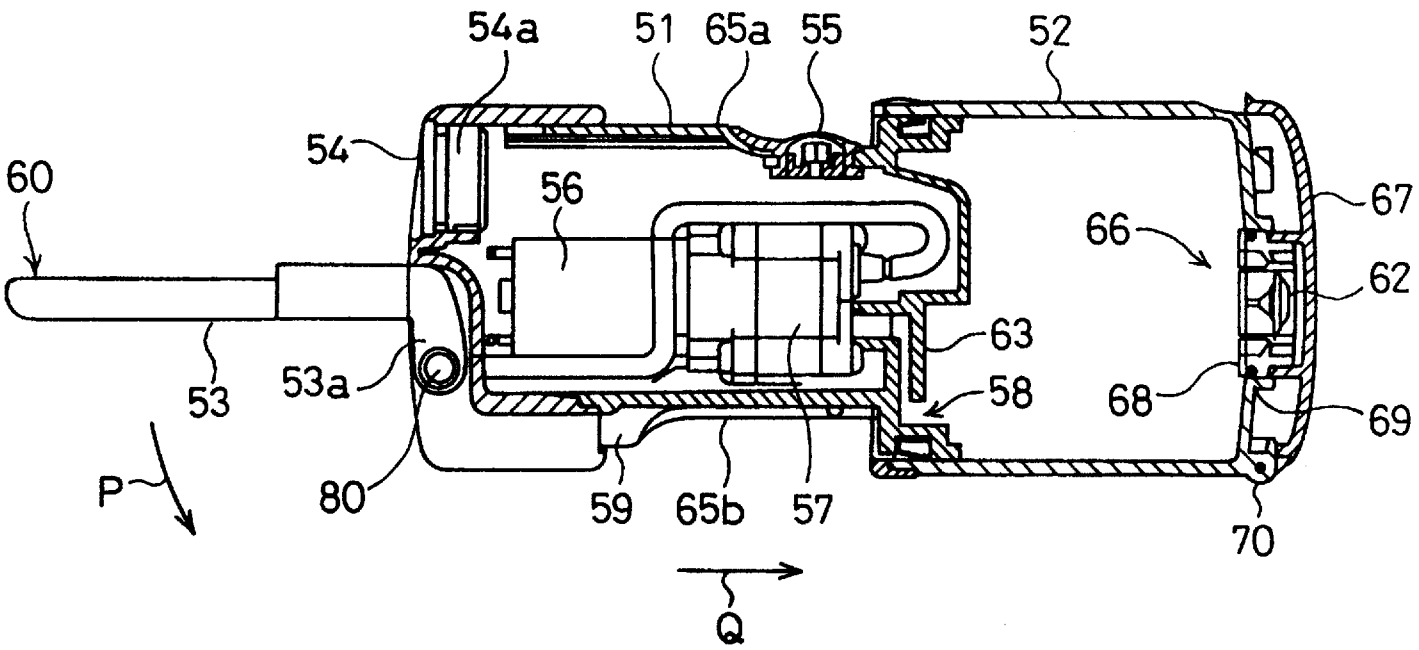
FIG. 12 is a cross sectional view illustrating the handy body washer of the second embodiment.

A handy body washer of a second embodiment shown in the perspective view of FIG. 11 and the cross sectional view of FIG. 12 includes a main body unit 51 in which a cell 54*a* working as a power source, a cell case 54 for accommodating the cell 54*a* therein, a motor 56 driven by electric power supplied from the cell 54*a*, and a pump 57 activated by the motor 56 are accommodated, a tank unit 52 which can store washing water or a washing liquid in use and be slidingly movable to cover the main body unit 51 in carriage, and a nozzle 53 that is pivotally movable relative to the main body unit 51 around a base end 53*a* thereof by means of a pivot 80 and has a plurality of jet nozzles 60 formed in the tip thereof, through which the washing water is jetted out. The main body unit 51 includes a dual-directional air valve 62 which enables the air to be fed into and released from the tank unit 52, in order to eliminate a variation in internal pressure of the tank unit 52.

The main body unit 51 is a plastic object having a substantially elliptical cross section, or more concretely an oval elliptical cylindrical member. A switch 55 for switching an operating condition of the motor 56 is mounted on a relatively smaller narrow-width face 65*a* which is parallel to a central axis of the oval elliptical cylindrical member and included in a circumferential surface located on one end of a major axis of the oval cross section. A groove-like nozzle-receiving member 59 for receiving the nozzle 53 is disposed on a relatively larger narrow-width face 65*b* which is parallel to the central axis of the oval elliptical cylindrical member and included in a circumferential surface located on the other end of the major axis of the oval cross section. Namely the switch 55 is arranged on the relatively smaller narrow-width face 65*a* located at a vertex of the oval cross section, whereas the nozzle-receiving member 59 is disposed on the relatively larger narrow-width face 65*b* located at a symmetrical position of the vertex. Since the groove-like nozzle-receiving member 59 for receiving the nozzle 53 is formed in the relatively larger narrow-width face 65*b*, the width of the groove can be readily adjusted to be suitable for the width of the nozzle 53.

A suction inlet 58, through which washing water stored in the tank unit 52 is fed into the pump 57, is located on one end 63 of the main body unit 51 facing to the tank unit 52. The suction inlet 58 is arranged at a position in the vicinity of the narrow-width face 65*b* in which the nozzle-receiving member 59 is formed. Since the suction inlet 58 is located in the vicinity of the lower most end of the tank unit 52 when the handy body washer is in use, washing water stored in the tank unit 52 can be effectively supplied to the pump 57.

Washing water pressingly fed by the pump 57 is led to the nozzle 53 and jetted out of the plurality of jet nozzles 60.

The nozzle 53 is attached to the main body unit 51 to allow pivotal movement thereof relative to the main body unit 51. For carriage, the nozzle 53 is rotated in a direction defined by the arrow P in FIG. 12 and received by the nozzle-receiving member 59.

The tank unit 52 stores washing water in use and receives the main body unit 51, which slides in a direction defined by the arrow Q in FIG. 12 and is inserted into the tank unit 52, in carriage. The tank unit 52 is composed of translucent or transparent plastics to enable the user to readily check the remaining amount of washing water stored therein. Washing water is fed through a water supply inlet 66 located on an outer end of the tank unit 52. The water supply inlet 66 is dosed with a plug 68 of a detachable inlet cover 67. An O ring 69 arranged on the circumference of the plug 68 effectively prevents water from leaking from the water supply inlet 66. The inlet cover 67 is further provided with the dual-directional air valve 62 that enables the air to be fed into and released from the tank unit 52 when the handy body washer is in use and when the tank unit 52 is slid against the main body unit 51 for carriage. The dual-directional air valve 62 is integrally incorporated in the plug 68. The inlet cover 67 has one end supported by the tank unit 52 via a pivot 70 to allow opening and dosing movements thereof.

The handy body washer of the embodiment thus constructed works in the following manner.

After the main body unit 51 is slidingly taken out of the tank unit 52, the nozzle 53 is pivotally moved around the base end 53*a* thereof to make the jet nozzles 60 formed in the nozzle 53 parallel to the switch 55 mounted on the main body unit 51.

The user then opens the inlet cover 67, feeds washing water into the tank unit 52 via the water supply inlet 66, and closes the inlet cover 67 again. A press of the switch 55 under such conditions applies a voltage to the motor 56, which activates the pump 57 to start sucking the washing water stored in the tank unit 52 up via the suction inlet 58 and make the sucked washing water run through the nozzle 53 and jetted out of the jet nozzles 60.

Figure 13:
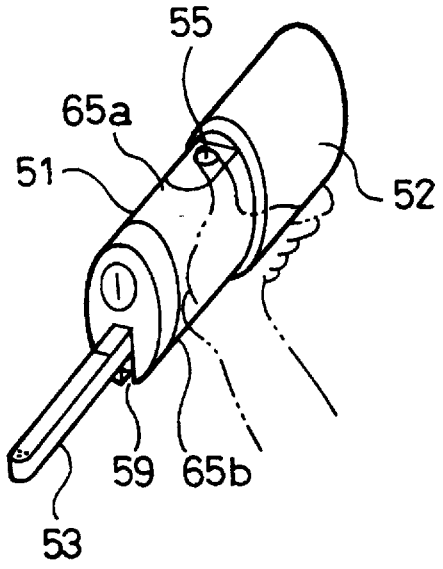
FIG. 13 is a perspective view illustrating the handy body washer of the second embodiment which the user holds.

FIG. 13 is a perspective view illustrating the handy body washer of the second embodiment which the user holds. With the narrow-width face 65*a* on which the switch 55 is mounted facing upward, the user holds the main body unit 51 by supporting the narrow-width face 65*b* having the nozzle-receiving member 59 disposed thereon with four fingers except the thumb while locating the thumb on the switch 55 of the narrow-width face 65*a*. When the pressing force of the thumb is increased, the switch 55 is turned on to start jetting the washing water out.

The handy body washer is generally used in a state that the nozzle 53 is inclined downward, so that it is rather difficult to check the spray direction of washing water. The user is accordingly required to detect the spray direction of washing water, based on the touch of washing water sprayed against the target part of the body, and vary the spray direction back and forward and left and right. The handy body washer of the embodiment can be moved appropriately simply by moving the thumb which presses the switch 55 while the other four fingers supporting the nozzle-receiving member 59 of the main body unit 51. This structure enables the spray direction of washing water to be readily varied, thereby remarkably improving the convenience of use.

Figure 14A:
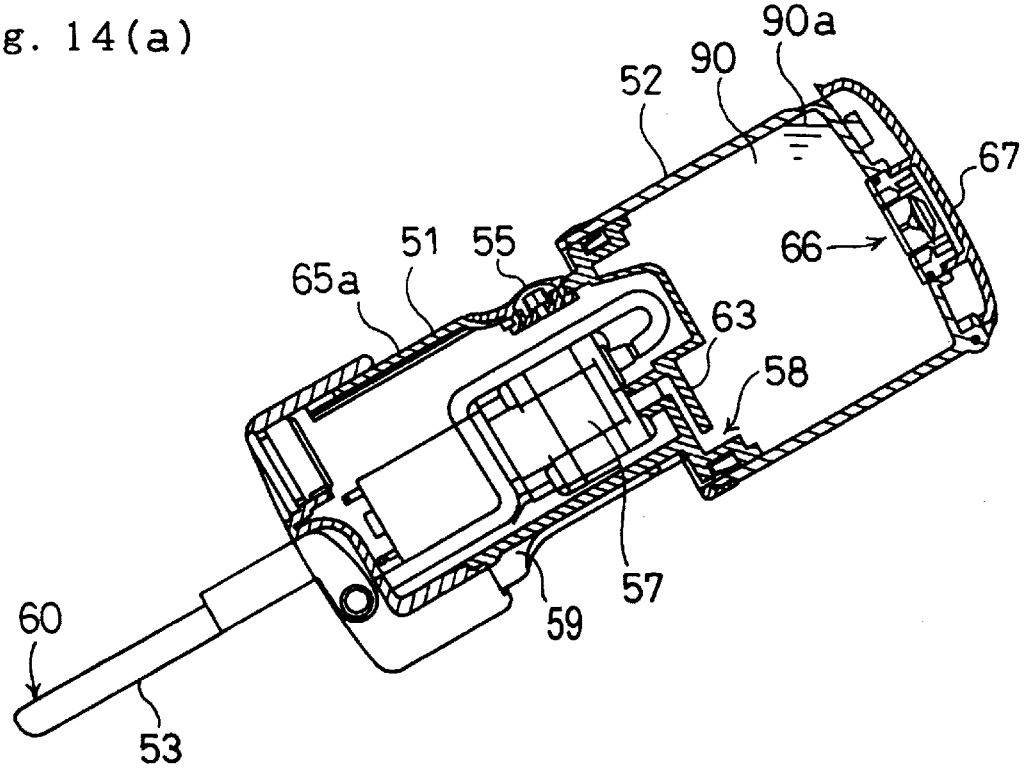
FIG. 14(*a*) is a cross sectional view illustrating the handy body washer of the second embodiment in a state immediately before a start of bathing.
Figure 14B:
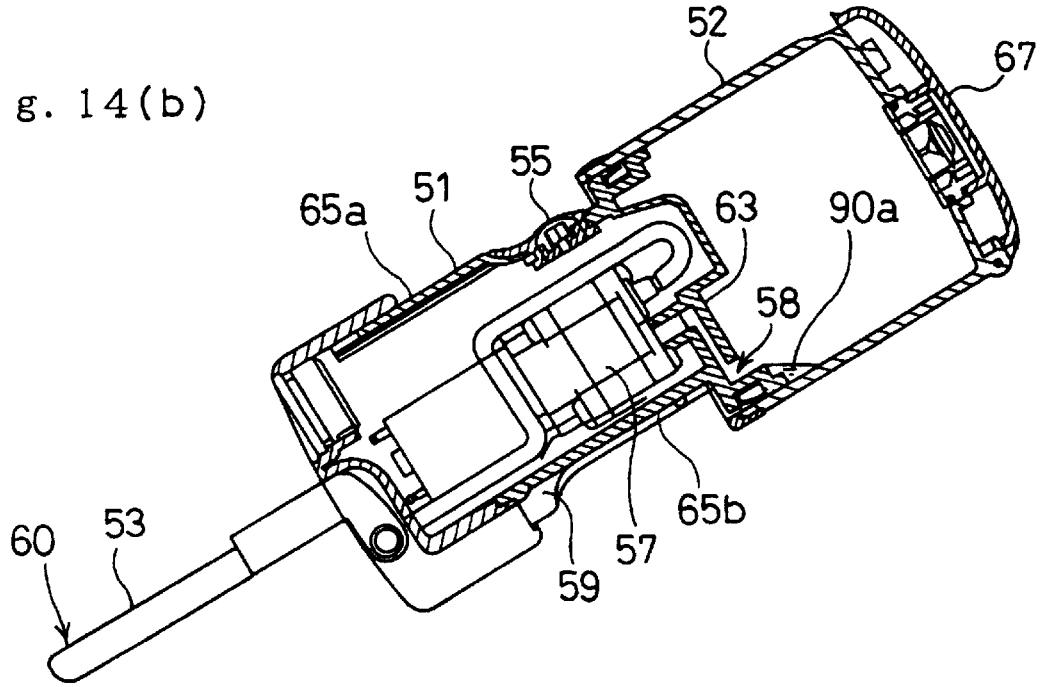

As the user presses the switch 55 to bathe the external genitals or the posterior parts of the body, the washing water stored in the tank unit 52 gradually decreases. FIG. 14(*a*) is a cross sectional view illustrating the handy body washer of the second embodiment in a state after feeding washing water 90 via the water supply inlet 66 and immediately before a start of bathing. The tank unit 52 is almost filled with the washing water 90. With the narrow-width face 65*a* having the switch 55 mounted thereon facing upward, the user uses the handy body washer while inclining the extension of the nozzle 53 downward. This means that the longitudinal direction of the handy body washer is inclined to dispose the tank unit 52 above the horizontal surface and the nozzle 53 below the horizontal surface. A liquid surface 90*a* of the washing water 90 accordingly exists on an upper end corner in the tank unit 52. With a decrease in amount of the washing water 90 stored, the liquid surface 90*a* of the washing water 90 in the tank unit 52 is gradually lowered. The liquid surface 90*a* is always inclined with respect to the longitudinal direction of the handy body washer.

FIG. 14(*b*) is a cross sectional view illustrating the handy body washer in a state immediately before a conclusion of bathing. When the liquid surface 90*a* is lowered to a place near the suction inlet 58, the air in the tank unit 52 as well as the washing water 90 is sucked in through the suction inlet 58, so that the sprayed amount of the washing water 90 decreases. When the liquid surface 90*a* is further lowered to a position below the lower end of the suction inlet 58, the washing water 90 is no longer supplied to the pump 57 and there is the remaining water 90 which can not be jetted out in a conventional structure. In the handy body washer of the embodiment, however, the suction inlet 58 is arranged at the position in the vicinity of the lower narrow-width face 65*b* on the end face 63 facing the tank unit 52. This enables the suction inlet 58 to connect with the lower-most position in the tank unit 52 when the handy body washer is in use. The cross section of the tank unit 52 is identical with the oval or substantially elliptical cross section of the main body unit 51, which allows the main body 51 to be slidingly inserted into the tank unit 52. The major axis of the substantially elliptical cross section defines the vertical direction of the handy body washer in use. This makes the tank unit 52 have a smaller width in the horizontal direction and a greater height in the vertical direction, thereby making a volume defined by the lower end of the suction inlet 58 and the lower-most surface of the tank unit 52 sufficiently small and effectively reducing the remaining water in the handy body washer.

The handy body washer of the embodiment can be used to make the width smaller in the horizontal direction as shown in FIG. 13. Compared with the conventional handy body washer shown in FIG. 2, the handy body washer of the embodiment requires the user to open the legs by a smaller degree, thereby improving the convenience of use.

The above embodiments are only illustrative and not restrictive in any sense. There may be many changes, modifications, and alterations without departing from the spirit and scope of the main characteristics of the invention. For example, the main body may have a regular elliptical cross section.

The handy body washer of the above embodiment can conveniently be used and remarkably decreases the amount of remaining water in the tank.

C. Third Embodiment

Figure 15A:
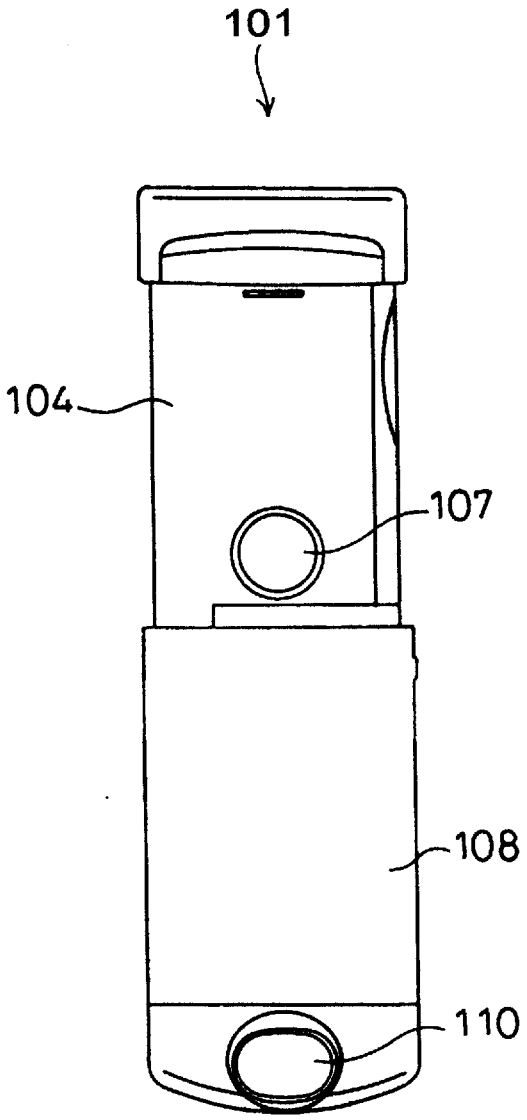
FIG. 15(*a*) shows a handy body washer as a third embodiment according to the present invention.
Figure 15B:
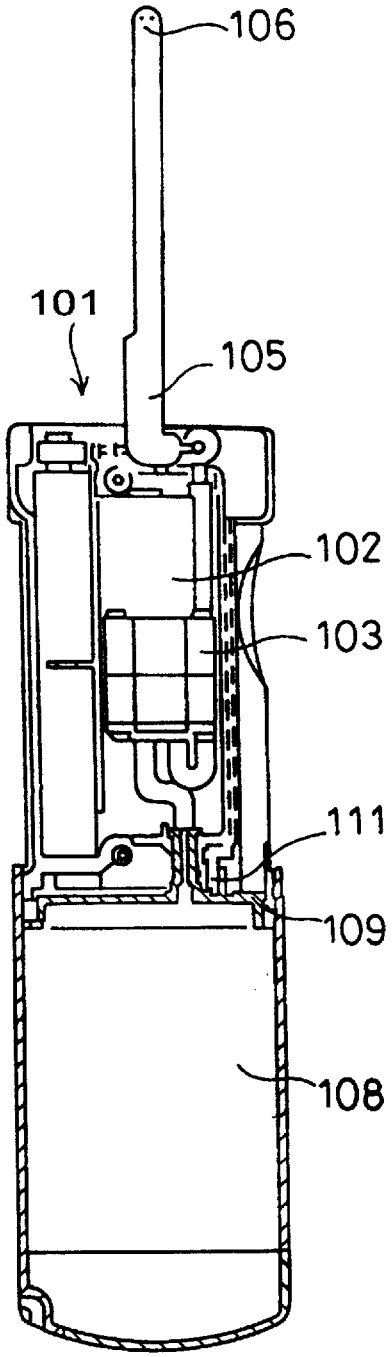
Figure 16A:
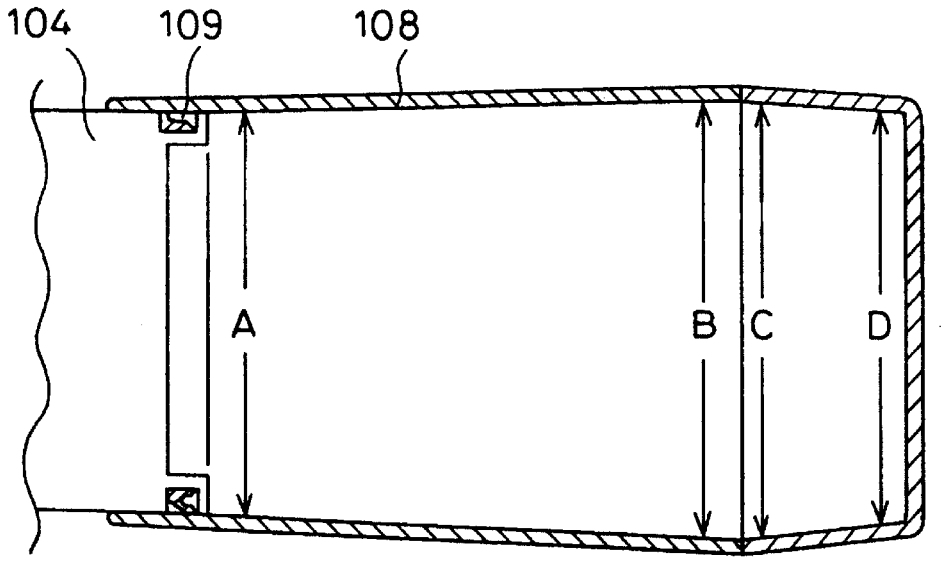
FIG. 16(*a*) schematically shows a relationship between a Y-shaped packing and a tank in a sliding movement in the third embodiment.
Figure 16B:
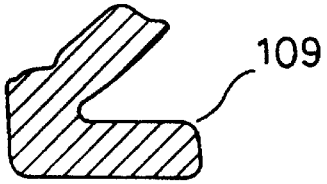
Figure 17:
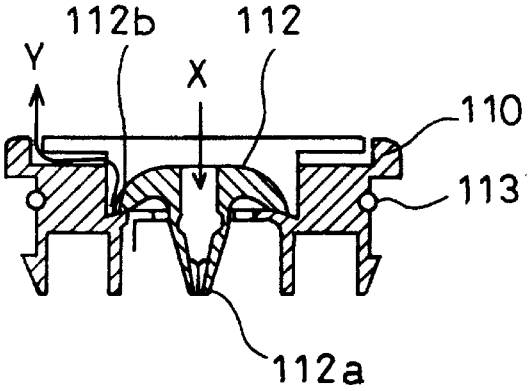
FIG. 17 is a cross sectional view illustrating a dual-directional air valve disposed in an inlet cover in the structure of the third embodiment.

FIG. 15(*a*) shows a handy body washer as a third embodiment according to the present invention; FIG. 15(*b*) is a cross sectional view illustrating the handy body washer of the third embodiment; FIG. 16(*a*) schematically shows a relationship between a Y-shaped packing and a tank in a sliding movement in the third embodiment; and FIG. 17 is a cross sectional view illustrating a dual-directional air valve disposed in an inlet cover. Referring to FIGS. 15(*a*) and 15(*b*), the handy body washer includes a main body 104 with cells 101 working as a power source, a motor 102, and a gear pump 103 accommodated therein, a nozzle 105 with a plurality of jet nozzles 106 through which washing water is jetted out, a switch 107 for applying a voltage to the motor 102 to activate the gear pump 103 when being pressed, and a resin tank 108 for storing washing water in use and receiving the main body 104, which is slidingly inserted therein, in carriage. The tank 108 is translucent or transparent to enable the user to readily check the remaining amount of washing water stored therein.

The handy body washer further includes a substantially Y-shaped packing 109 (see the cross sectional view of FIG. 16(*b*)) for preventing water from leaking from the sliding surfaces of the main body 104 and the tank 108, an inlet cover 110 attached to and detached from a water supply inlet, through which washing water is fed into the tank 108, a suction inlet 111 through which washing water stored in the tank 108 is sucked up by the gear pump 103, and a dual-directional air valve 112 to enable the air to be fed into and discharged from the tank 108. The inlet cover 110 is tightly held to the tank 108 by means of an O ring 113 as shown in FIG. 17.

The handy body washer of the third embodiment thus constructed works in the following manner. When the main body 104 is taken out of the tank 108, the substantially Y-shaped packing 109 slides against the inner wall of the tank 108 of elliptical shape whose inner diameter gradually varies, by means of the draft taper of resin molding. The nozzle 105 is then swung around the base end thereof and taken out of the main body 104 to be arranged parallel to the main body 104 and align the jet nozzles 106 formed on the tip of the nozzle 105 with the switch 107. The user holds the main body 104 with a hand, feeds either cold water or hot water from the faucet into the tank 108 via the water supply inlet formed in the rear portion of the tank 108, and closes the water supply inlet with the inlet cover 110. The O ring 113 disposed around the inlet cover 110 effectively prevents washing water from leaking from the water supply inlet. A press of the switch 107 under such conditions applies a voltage to the motor 102 and activates the gear pump 103 to start sucking the washing water stored in the tank 108 up via the suction inlet 111 and make the sucked washing water run through the nozzle 105 and jetted out of the jet nozzles 106.

A vane pump, a Roots blow pump, a diaphragm pump, or a piston pump can be preferably used in place of the gear pump. The vane pump is a volume rotating pump, in which a rotor having a plurality of variable blades rotates in contact with an eccentric casing to vary the volume of a sealing cavity space while rotating the sealing cavity space, thereby pressing a liquid sealed in the cavity space from a suction side to a spout side. The Roots blow pump is also a volume rotating pump, in which each rotor of the gear pump has only two teeth and rotates in a very narrow gap against a casing, thereby pressing a liquid from a suction side to a spout side. The diaphragm pump is a volume reciprocating pump, in which a liquid is pressingly fed from a suction side to a spout side by taking advantage of a variation in volume due to a vertical movement of a rubber diaphragm. The piston pump is also a volume reciprocating pump, in which a liquid is pressingly fed from a suction side to a spout side by means of a check valve and a piston or a plunger reciprocating by a swash plate, a cam, or a crank.

Referring to FIG. 17, the dual-directional air valve 112 disposed in the inlet cover 110 opens a part 112*a* to feed the air into the tank 108 as shown by the arrow X and make the air pressure in the tank 108 constant. After the whole washing water stored in the tank 108 is jetted out, the nozzle 105 is received in the main body 104, which is subsequently accommodated in the tank 108. The substantially Y-shaped packing 109 has an expandable width for sufficiently covering the variation in diameter of the inner wall of the tank 108, which enables the remaining water adhering to the inner wall of the tank 108 to be used effectively. The substantially Y-shaped packing 109 is composed of ethylene propylene rubber or fluororubber coated with a fluorine admixture, which ensures sufficient durability and operability. Silicone rubber also exerts the same effects and is thus suitable for the packing 109.

Referring again to FIG. 17, in a sliding movement, a part 112(*b*) of the dual-directional air valve 112 disposed in the inlet cover 110 is lifted up to release the air from the tank 108 as shown by the arrow Y and enable the main body 104 to be smoothly received and accommodated in the tank 108. A suction part 112(*a*) of the dual-directional air valve 112 for feeding the air into the tank 108 forms an outer concentric circle, while an exhaust part 112(*b*) for releasing the air from the tank 108 forms an inner concentric circle. This configuration is attributed to the fact that the latter part 112(*b*) suffers a greater variation in air pressure and thereby requires a larger cross section.

As discussed above, the structure of the embodiment including the main body sliding against the resin tank enables the whole washing water stored in the tank to be effectively used without leaking the remaining water from the sliding surfaces of the tank and the main body.

The dual-directional air valve and the elliptical water supply inlet effectively absorb the vibrations occurring when the user feeds washing water into the tank and remarkably improve the convenience of use without making the tank unnecessarily bulky.

A scale on the surface of the translucent or transparent tank informs the user of the remaining amount of washing water stored in the tank.

The handy body washer of the above embodiment is characterized by the substantially Y-shaped packing attached to the main body to slide against the inner wall of the tank, the dual-directional air valve enabling the air to be fed into and released from the tank, and the elliptical water supply inlet whose minor axis is arranged in the longitudinal direction of the tank. This structure ensures the sufficient bathing effect of the handy body washer in use and enables the handy body washer to be made compact and free from leakage of the remaining water in carriage. The unity structure of the air valve makes the handy body washer sufficiently compact without sacrificing the convenience when washing water is fed into the tank.

Although the present invention has been described and illustrated in detail, it is dearly understood that the same is by way of illustration and example only and is not to be taken by way of limitation, the spirit and scope of the present invention being limited only by the terms of the appended claims.

What is claimed is:

1. A handy body washer comprising:

a main body;

a pump accommodated in said main body;

a tank, slidably attached to said main body to house said main body therein, for storing washing water; and a retractable nozzle member, connected to said main body, having a free end and a plurality of nozzle apertures formed proximate said free end, said plurality of nozzle apertures jetting out the washing water pumped out by said pump; and wherein said tank comprises:

(i) a bottomed cylindrical body having an open top end and a bottom end, said bottom end having a water supply opening;

(ii) a water supply cover pivotally supported on said bottom end for opening and closing said water supply opening; and (iii) a gutter formed in an inner surface of said water supply cover for introducing the washing water flowing downward into said water supply opening while said water supply cover is open.

2. A handy body washer in accordance with claim 1, wherein said gutter is arranged to face toward said water supply opening when said water supply cover is held at a predetermined opening angle.

3. A handy body washer in accordance with claim 1, wherein said gutter comprises a restriction plate arranged inside said gutter for working as a splash guard.

4. A hand-held body washer comprising:

a portable main body;

a pump accommodated in said main body;

a power cell contained in said main body to power said pump;

a tank for storing washing water;

a nozzle member, connected to said main body, having a free end and a plurality of nozzle apertures formed proximate to said free end, said plurality of nozzle apertures jetting out washing water pumped out by said pump; and manually operated nozzle adjusting means for manually adjusting a number of said nozzle apertures to be used to jet out the washing water.

5. A hand-held body washer in accordance with claim 4, wherein said nozzle adjusting means comprises a sealing member, slidably attached to said nozzle member, for closing and opening a first part of said plurality of nozzle apertures while maintaining a second part of said plurality of nozzle apertures.

6. A hand-held body washer in accordance with claim 5, wherein said first part of said plurality of nozzle apertures is formed at an elevation higher than said second part of said plurality of nozzle apertures, and wherein, said nozzle adjusting means comprises means for moving said sealing member slidably onto said elevation to close said first part of said plurality of nozzle apertures.

7. A hand-held body washer used for bathing the posterior parts or the external genitals of the body, said hand-held body washer comprising:

a main body which a cell functioning as a power source, a motor driven by electric power supplied from said cell, and a pump activated by said motor are accommodated in;

a tank unit which can store a washing liquid in use and be slidingly movable to cover said main body in carriage; and a nozzle having a first end pivotally attached to said main body and a second end with one or a plurality of jet nozzles from which the washing liquid is jetted, wherein said main body comprises an elliptical cylindrical member having a substantially elliptical cross section, said elliptical cylindrical member further comprising a switch for switching an operating condition of said motor, a nozzle-receiving member for receiving said nozzle and enabling said main body to be slidingly movable into said tank unit, and a water supply inlet for feeding the washing liquid stored in said tank unit to said pump, said switch being mounted on a first narrow-width face which is parallel to a central axis of said elliptical cylindrical member and included in a circumferential surface located on one end of a major axis of the substantially elliptical cross section, said nozzle-receiving member being disposed on a second narrow-width face which is parallel to the central axis of said elliptical cylindrical member and included in a circumferential surface located on the other end of the major axis of the substantially elliptical cross section, said water supply inlet being located on one end of said elliptical cylindrical member, which faces to said tank unit, and arranged in a vicinity of either said first narrow-width face or said second narrow-width face.

8. A hand-held body washer in accordance with claim 7, wherein the cross section of said elliptical cylindrical member of said main body has an oval shape, said switch being mounted on a relatively smaller narrow-width face which is parallel to the central axis of said elliptical cylindrical member and included in the circumferential surface located on one end of the major axis of the oval cross section, said nozzle-receiving member being disposed on a relatively greater narrow-width face which is parallel to the central axis of said elliptical cylindrical member and included in a circumferential surface located on the other end of the major axis of the oval cross section.

9. A hand-held body washer used for bathing the posterior parts or the external genitals of the body, said hand-held body washer comprising:

a portable main body with a washing mechanism integrally accommodated in a casing, a liquid being jetted from said washing mechanism in order to bathe the posterior parts or the external genitals of the body;

a tank which can store the liquid in use and receive said main body in carriage;

a water supply inlet through which the liquid is supplied into said tank, and a tank unit having a suction valve and an exhaust valve, wherein said tank unit has a sliding surface which slides against said main body, said main body being slidingly inserted into said tank unit via a substantially Y-shaped packing.

10. A hand-held body washer in accordance with claim 9, wherein said washing mechanism further comprises a cell functioning as a power source, a motor driven by electric power supplied from said cell, a pump activated by said motor, and a nozzle through which the liquid fed by said pump is discharged.

11. A hand-held body washer in accordance with claim 10, wherein said pump is one selected among the group consisting of a gear pump, a vane pump, a Roots blow pump, a diaphragm pump, and a piston pump.

12. A hand-held body washer in accordance with claim 9, wherein said substantially Y-shaped packing comprises ethylene propylene rubber or fluororubber coated with a flourine admixture or silicone rubber.

13. A hand-held body washer in accordance with claim 9, wherein said suction valve and said exhaust valve are arranged in a substantially concentric configuration, in which said suction valve constitutes an inner concentric circle and said exhaust valve an outer concentric circle.

* * * * *